United States Patent [19]

Tassone

[11] 4,136,869

[45] Jan. 30, 1979

[54] BALL TEE

[76] Inventor: Joseph V. Tassone, 2425 Rawnsdale Rd., Kettering, Ohio 45440

[21] Appl. No.: 721,060

[22] Filed: Sep. 7, 1976

Related U.S. Application Data

[60] Continuation of Ser. No. 517,895, Oct. 25, 1974, abandoned, which is a division of Ser. No. 258,863, Jun. 1, 1972, Pat. No. 3,853,878.

[51] Int. Cl.[2] ..... A63B 69/40

[52] U.S. Cl. ..... 273/26 R

[58] Field of Search ..... 273/26 R, 26 E, 26 A, 273/29 A, 95 A, 33, 200 R, 202; 404/10, 11, 12; 116/114 AH, 114 R

[56] References Cited

U.S. PATENT DOCUMENTS

| | | | |
|---|---|---|---|
| 712,786 | 11/1902 | Flint | 46/155 |
| 1,564,212 | 12/1925 | Decker | 273/203 |
| 1,675,335 | 7/1928 | Drevitson | 273/202 |
| 2,333,273 | 11/1943 | Scanlon | 404/10 |
| 2,527,906 | 10/1950 | Bennett et al. | 273/26 R |
| 2,805,071 | 9/1957 | Kaplan | 273/202 |
| 2,976,041 | 3/1961 | White | 273/26 R |
| 3,039,770 | 6/1962 | Ferretti | 273/26 R |
| 3,139,282 | 6/1964 | Lande | 273/26 R |
| 3,183,000 | 5/1965 | Dix | 273/26 R |
| 3,192,889 | 7/1965 | Crudgington | 404/10 |

FOREIGN PATENT DOCUMENTS

| | | | |
|---|---|---|---|
| 170476 | 10/1921 | United Kingdom | 273/202 |

*Primary Examiner*—Richard C. Pinkham
*Assistant Examiner*—T. Brown
*Attorney, Agent, or Firm*—Candor, Candor & Tassone

[57] ABSTRACT

A ball tee is provided having a base and an upstanding column carried by the base and having means for supporting a ball thereon. The column and base are made entirely of a yieldable resilient material enabling the column to be struck by a ball bat with the column and bat remaining intact and enabling the base and the major portion of the column to be easily flattened upon applying compressive forces thereagainst to thereby assure a person falling thereon will not be injured.

1 Claim, 13 Drawing Figures

BALL TEE

This is a continuation of application Ser. No. 517,895, filed Oct. 25, 1974, abandoned, which is a division of Ser. No. 258,863, filed June 1, 1972 now U.S. Pat. No. 3,853,878.

The popularity of ball games such as baseball, softball, and the like, is well known; however, particularly with young children starting at roughly age 5, it is difficult to play these ball games because a pitcher and a catcher are required. At the above-mentioned age and even with some children as old as roughly 10 years of age, it is dangerous to have a catcher stand too close to a young batter swinging a bat because of the poor control which such batter has over the bat. Further, particularly in baseball, young pitchers do not have the ability or physical strength to consistently pitch a ball across home plate to assure that the game will progress at reasonable speed. In addition, with the increased number of arm injuries in recent years, such as so-called "Little League elbow," it is desirable to reduce the pitching stress on the arms of young children.

BACKGROUND OF THE INVENTION

Therefore, a modified form of baseball, popularly referred to as "tee ball," has been introduced for young children and has had remarkable success. As the name suggests, the game is played with a ball supported on a tee and struck with a bat while the tee is placed on home plate of a regular ball diamond. The ball is usually supported at about waist height to enable the batter to make easy contact with the ball with a smooth, even swing.

With this arrangement the pitcher is not required to pitch the ball and in actual play is required to keep one foot on the pitching rubber until a batter hits the ball, whereupon he may move away from the rubber to field the ball or otherwise assist in defensive play. Similarly, the catcher is required to stand a considerable distance away from the tee on home plate (and a swinging bat) where he is less likely to be injured by the batter. Once the ball is hit, the catcher assumes the normal defensive role of a catcher.

Generally the basic rules which govern play in major league baseball, as played in the United States, apply to tee ball, with modifications such as mentioned above to enable use of a tee. In addition, for young boys the bases are usually 60 feet apart in the usual diamond pattern and the pitcher's rubber is 45 feet from home plate.

In most instances the infield positions are the same as played by major league baseball teams; however, the outfield positions may vary in number from the usual 3 to as many as 5, where it is desired to allow participation by more players. Also, to prevent a particular team from remaining at bat too long, limitations are usually placed as to the number of batters that may bat in a given inning and this number is usually the number of players on the team. Thus, with teams of eleven players each, once the eleventh player comes to bat and regardless of the number of outs prior to that time, after the ball is in play as the result of the eleventh batter's action, all action and scoring are stopped merely by playing the ball home and tagging home plate.

Tee ball games may vary in length to suit local situations; however, they are usually six innings in length, and a complete six inning game with the home team batting in the sixth may be completed usually within roughly one and one-half hours.

It will be appreciated that in order for tee ball to be successful it is necessary to have a tee that a young batter will not be afraid to hit with a regular baseball bat because it might sting his hands. In addition, it is desirable that the tee be such that it supports the ball at a height, in the strike zone, where it may be easily hit with a level swing.

It is of extreme importance that the tee be safe. Preferably, the tee should be constructed so that it may be easily knocked down and once knocked down it should be constructed so that it will not injure a young player sliding thereacross or falling thereon. Therefore, such tee should have a supporting base which provides support for the tee and a ball resting thereon during normal use; however, it should have a base and column which is easily collapsible or flattened. Further, the base and upstanding column of such tee should be free of rigid projections, particularly metallic projections which would cause wounds if a player were to fall thereon.

Numerous tees have been proposed heretofore and such tees include both homemade tees and those designed and manufactured for tee ball. Categorically, all of these previously proposed tees are unsafe for children and the manufactured tees are also too expensive. For example, one common tee is comprised of a plumber's helper having a rubber base and a wooden handle threadedly fastened thereon. A rubber hose is often attached concentrically around the wooden handle with a metal hose clamp of the automobile radiator type. However, with this type of tee the wooden column or handle portion is easily knocked out of the base. Further, such column usually breaks and splinters, producing pieces which could injure a player; and, obviously, the wooden portion of the handle within a rubber hose does not allow it to collapse. In addition, the metal hose clamps used with such a tee have numerous projections which are very dangerous.

Other tees in current use are made substantially of metal and include metal bases and metal column portions which may have a rubber hose section for supporting the ball. These tees are especially undesirable because a young batter will invariably hit the metal column, damage his bat, and often injure his hands. Also, most of these tees with metal columns have pins projecting therefrom which are used to adjust the height of the column and these pins are very dangerous.

Still other tees proposed heretofore provide a rigid home plate, having the usual configuration, fixed to the base of the metal column. These tees once knocked over (as they routinely are) are hazardous because they hold the sharp pointed edges of home plate so that a person may fall thereon and be seriously injured.

SUMMARY

This invention provides an improved safe ball tee which may be used by young children. The tee is of simple and economical construction, is light in weight, and is capable of reliably withstanding considerable usage and even abuse through several baseball seasons. The tee comprises a base and an upstanding column carried by the base and having means for supporting a ball on such column. The column and base are made primarily of a yieldable resilient material and are constructed to enable the column to be struck by a ball bat and easily knocked down with the column and bat remaining intact and once knocked down enabling the base and the major portion of the column to be easily flattened upon applying compressive forces thereagainst to thereby assure a person falling thereagainst will be free of injury.

Other details, uses, and advantages of this invention will be readily apparent from the exemplary embodiments thereof presented in the following specification, claims, and drawing.

BRIEF DESCRIPTION OF THE DRAWING

The accompanying drawing shows present preferred embodiments of this invention, in which.

DESCRIPTION OF ILLUSTRATED EMBODIMENTS

Figure 1:
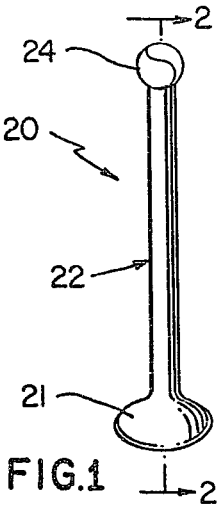
FIG. 1 is a perspective view of one exemplary embodiment of the ball tee of this invention.
Figure 2:
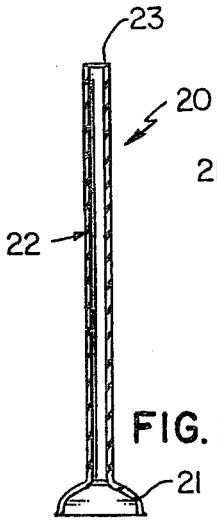
FIG. 2 is a cross-sectional view taken essentially on the line 2—2 of FIG. 1.

Reference is now made to FIGS. 1 and 2 of the drawing wherein one exemplary embodiment of a ball tee of this invention is illustrated and designated generally by the reference numeral 20. The tee 20 may be used in playing games such as baseball, softball, and the like, or such tee may be used to teach a young batter the correct way to swing a ball bat.

The tee 20 comprises a base 21 and an upstanding column 22 having means for supporting a ball such as a standard baseball or standard softball thereon and such supporting means in this example comprises an annular surface 23 adapted to support a baseball 24 thereon. The base 21 and column 22 are made of any suitable material such as a yieldable resilient elastomeric material such as natural rubber, synthetic rubber, or a suitable plastic material such as a polymer, or the like.

The material used to make the tee 20 has properties such that the column 22 may be struck with a regular wooden or aluminum ball bat with the column and bat remaining intact, i.e., in an undamaged condition, and without injuring or otherwise transmitting an undesirable stinging sensation to the hands of the batter. In addition, the base 21 and column 22 are constructed such that it may be easily flattened upon applying compressive forces thereagainst and as indicated by the arrow 25 in FIG. 3. Thus, when such tee 20 is knocked down, as is desireable once the tee is hit directly or tipped in the case of hitting a lower portion of the ball 24, a person falling or sliding thereon would not be injured by either the column 22 or base 21 of such tee.

The tee 20 is made with the base 21 and column 21 as a single piece construction and the base 21 has a roughly cup-shaped or frustoconical configuration with the column 22 having a tubular configuration. Because of its simple construction the tee 20 is comparatively inexpensive whereby an organized team may possess several tees with columns 22 of different heights. Ordinarily a team having 7 and 8 year old boys will only require two and at the most three tees having different heights.

Other exemplary embodiments of tees of this invention are illustrated in FIGS. 4, 5, 7, and 9 of the drawing. The tees illustrated in FIGS. 4, 5, 7, and 9 are similar to the tee 20; therefore, such tees will be designated by the reference numerals 20A, 20B, 20C, and 20D respectively and representative parts of each tee which are similar to corresponding parts of the tee 20 will be designated in the drawing by the same reference numeral as in the tee 20 (whether or not such parts are mentioned in the specification) followed by an associated letter designation, either A, B, C, or D and not described again in detail. Only those component parts of each tee which are different from corresponding parts of the tee 20 will be designated by a new reference numeral also followed by the associated letter designation and described in detail.

Figure 4:
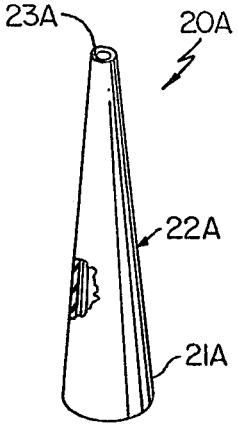
FIG. 4 is a perspective view with a portion thereof broken away illustrating another embodiment of the ball tee of this invention.
Figure 4A:
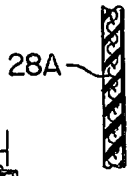
FIG. 4A is an enlarged fragmentary cross-sectional view showing reinforcing means which may comprise the roughly frustoconical wall of the tee of FIG. 4.

The tee 20A of FIG. 4 has a substantially frustonical outside surface and also has a base portion 21A and upstanding column 22A which terminates in a top annular supporting means or surface 23A for supporting a ball thereon. The entire tee 20A is made of an elastomeric material and may have suitable reinforcing means embedded therein and in this example such reinforcing means is in the form of an embedded woven fabric 28A which is also impregnated with elastomeric material, see FIG. 4A.

The tee 20A may be made as a tubular unitary structure, as shown, using any suitable molding technique known in the art and may also be made from a roughly trapezoidal flat sheet having arcuate top and bottom edges and suitable fastening means along its opposite side edges. In addition the tee 20A may be made of a solid piece of compressible foamed elastomeric material provided with a suitable ball supporting means at the top thereof and such foamed material may be suitably reinforced with stiffening particles embedded therein. If desired, such solid tee may have a moisture impervious plastic film covering its entire exposed surface to prevent water saturation thereof.

Figure 5:
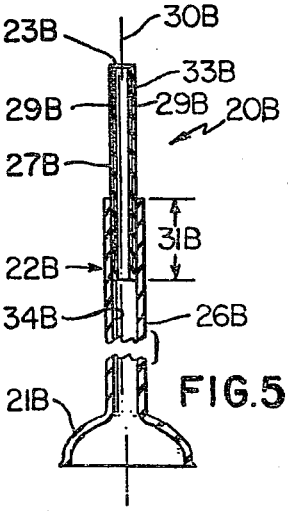
FIG. 5 is a fragmentary cross-sectional view similar to FIG. 2 illustrating another exemplary embodiment of the tee of this invention having a base and an upstanding column supported by the base and comprised of an upper and a lower part with the lower part being provided as an integral part of the base.

The tee 20B of FIG. 5 has a base 21B and a column 22B comprised of a plurality of cooperating interconnected parts shown as a lower part 26B and an upper part 27B which are coaxially arranged, i.e., have a common longitudinal vertical axis 30B. The lower part 26B is fixed to the base 21B and in this example such lower part 26B is provided as an integral part of the base.

The upper part 27B is arranged in telescoped relation within the lower part 26B with a substantial portion of each part being telescoped or overlapped as indicated at 31B. With this arrangement, the upper part 27B is readily axially adjustable, either up or down, to an infinite number of positions relative to the lower part 26B to change the position of the supporting means or annular supporting surface 23B defining the top of the upper part 27B and thereby enable a batter using the tee 20B to position a ball at any desired position which will allow easier hitting thereof while taking a normal swing with a ball bat. The upper tubular part 27B has suitable reinforcing means 29B therein (shown in the drawing by vertical lines 29B) and such reinforcing means helps to prevent deformation due to striking of such part with a bat yet does not substantially impair its collapsability upon applying compressive forces thereagainst and such reinforcing means may be in the form of embedded spaced spring-like rods or a layer of fabric means.

Each of the parts 26B and 27B is in the form of a tubular part and the upper part 27B has an outside substantially right circular cylindrical friction surface 33B while the lower part 26B has a cooperating substantially right circular cylindrical inside friction surface 34B. The parts 26B and 27B are dimensioned so that with the upper part 27B telescoped in position the surfaces 33B and 34B frictionally hold the upper part 27B in telescoped relation at any of the infinite number of positions, defined by the amount of overlap 31B, and maintain the upper part 27B in position even with repeated striking of a ball bat thereagainst in the event the batter misses the ball and strikes such upper part. In addition, the frictional engagement between parts is such that a young ball player may make his own vertical adjustment of part 27B.

Figure 5A:
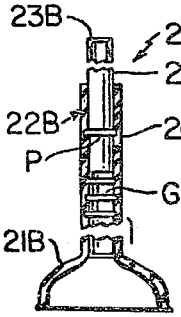
FIG. 5A is a view similar to FIG. 5 and is a modification of the tee of FIG. 5.

A modification of the tee of FIG. 5 is shown in FIG. 5A wherein the lower tubular part 26B has vertically spaced grooves G extending from its inside surface 34B into its wall. The upper part 27B has at least one annular projection P extending outwardly therefrom and the projection P is adapted to be received in each of the grooves G. Thus, the upper part 27B may be adjusted fixed increments vertically within the lower part 26B by moving part 27B so that its projection P meshes within a different one of the vertically spaced grooves G. It will be appreciated that each groove G and projection P serves as locking means for locking the upper part 27B in position once an adjustment has been made and during movement between grooves G the projection merely causes the tubular increment between grooves G to bulge outwardly temporarily.

Figure 6:
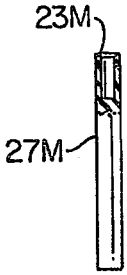
FIG. 6 is a view, with a portion in cross-section, illustrating an upper part of a column which may be used interchangeably with the upper part of the column of the tee of FIG. 5.

The upper part of tee 20B instead of being tubular may be of solid cross-sectional configuration and such a part is illustrated in FIG. 6 and designated by the reference numeral 27M. The part 27M may be used interchangeably with part 27B and part 27M also has a top annular ball-supporting surface 23M.

Figure 7:
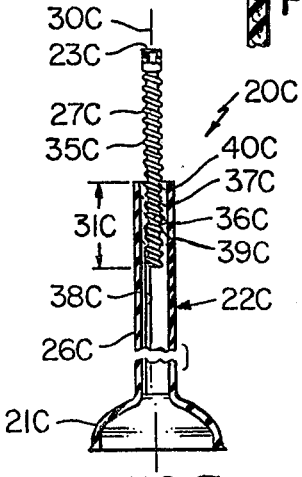
FIG. 7 is a view similar to FIG. 5 illustrating another exemplary embodiment of the tee of this invention.

The tee 20C illustrated in FIG. 7 comprises a base 21C adjoined by a lower part 26C fixed to the base 21C and having a substantially vertical longitudinal axis 30C and an upper part 27C having an annular ball supporting means or surface 23C provided thereon. One of the parts, shown as the upper part 27C in this example, has an outer convoluted or helical configuration defining male or outside roughly helical threads 35C and the other part 26C of this example has cooperating inside threads or a threaded portion 36C. The parts 26C and 27C are arranged in telescoped relation and also have overlapped portions as indicated at 31C with the cooperating threads 35C and 36C being in threaded engagement so that these threads cooperate to hold the upper part 27C within part 26C at any of an infinite number of positions. Further, the amount that part 27C is telescoped within part 26C and thus the vertical position of annular surface 23C is adjusted simply by threading part 27C within or out of part 26C in the usual manner.

The threaded portion 36C comprising part 26C may be provided as an integral portion of part 26C; however, in this example such portion is provided as an insert 40C made of a suitable elastomeric material and having an outside surface 37C bonded against the inside surface 38C of part 26C by a suitable adhesive means 39C.

The upper part 27C of column 22C comprising the tee 20C may also be made of a solid highly flexible elastomeric material rather than a tubular material and such a solid upper part would be similar to part 27M shown in FIG. 6 yet be provided with external threads similar to threads 35C along the lower portion thereof for threaded engagement with threaded portion 36C and in a similar manner as described previously. Such a solid upper part 27C would also be provided with suitable ball supporting means and like part 27M could be easily flattened.

Figure 8:
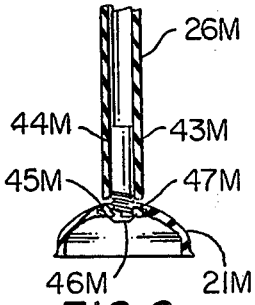
FIG. 8 is a fragmentary cross-sectional view illustrating a modification of the tee of this invention having an upstanding column which is detachably fastened to the base.

The columns 22, 22B, and 22C comprising the tees 20, 20B, and 20C respectively are shown in each instance as being defined with a lower part provided as an integral part of the base as a single piece construction. However, it will be appreciated that tees 20, 20B and 20C, for example, may be suitably modified so that the lower part of each of these tees, designated by the reference numeral 26M in FIG. 8, may be provided with a threaded connector 43M suitably fixed thereto as by adhesive means 44M and such threaded connector may be threadedly received in an associated base which is designated 21M. In particular, the base 21M may have a plate 45M fixed thereto as by partial embedment and fixed thereto during molding, or the like, and such plate may be made of any suitable material and provided with internal threads 46M to threadedly receive the male threads 47M of the connector 43M.

Figure 3:
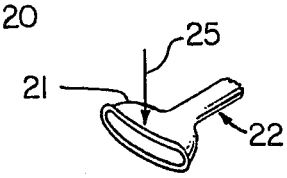
FIG. 3 is a fragmentary perspective view illustrating the manner in which the base and column comprising the tee of FIG. 1 may be easily flattened upon applying a force substantially transverse the column and against an edge thereof.

The bases 21A, 21B, and 21C of tees 20A, 20B, and 20C respectively as well as the base 21M are all easily compressed or flattened in a substantially identical manner as the base 21 shown in FIG. 3. Thus, once the associated tee is knocked down and a player accidentally falls thereon such player will not be injured by the tee.

Figure 9:
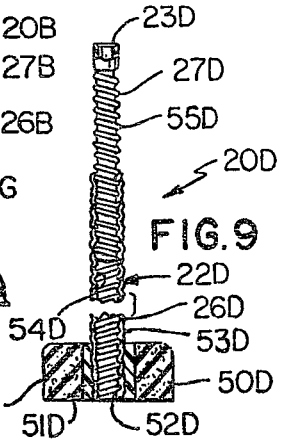
FIG. 9 is a cross-sectional view similar to FIG. 5 illustrating another exemplary embodiment of the tee of this invention.
Figure 10:
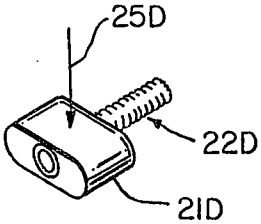
FIG. 10 is a view similar to FIG. 3 illustrating the manner in which the base of the tee of FIG. 9 may be easily flattened.

The tee 20D illustrated in FIG. 9 has a base 21D which is made of a foamed material which in this example is shown as foamed rubber. The foamed rubber comprising the base 21C may have suitable stiffening materials or particles 50D embedded therein to provide such base with sufficient rigidity to enable the base to hold the column 22D in an upright manner yet the construction of the base 21D is such that it is easily compressed upon applying forces such as a force indicated by the arrow 25D in FIG. 9 of the drawing whereby a person falling thereon would not be injured thereby.

The base 21D has a comparatively more rigid small diameter insert 51D suitably embedded therein and such insert is made of a suitable metallic or non-metallic material and has internal threads 52D which threadedly receive external threads 53D defined on a substantially tubular lower part 26D of column 22D. The threads 53D are defined by a helical configuration of lower part 26D and once part 26D is threaded within insert 51D it holds part 26D in an upright manner. The helically convoluted lower part 26D also has integral internal threads 54D which are used for a purpose to be subsequently described.

The column 22D has a helically convoluted tubular upper part 27D provided with external threads 55D which are threadedly received within the internal threads 54D of the lower part 26D and part 27D also has supporting means in the form of an annular surface 23D for supporting a ball thereon. The dimensions of parts 26D and 27D are such that the external threads 55D are threadedly received within internal threads 54D enabling the upper part 27D to be telescoped relative to the lower part 26D by threading part 27D relative to part 26D in the usual manner and thereby adjust part 27D and its top ball-supporting surface 23D to an infinite number of vertical positions.

Figure 11:
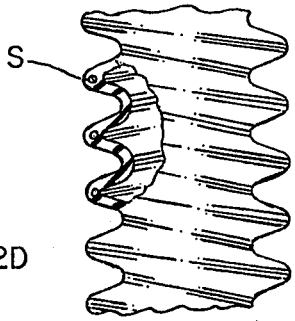
FIG. 11 is an enlarged fragmentary perspective view particularly illustrating typical integral spring means embedded in the convoluted configuration of the upper part of the column comprising the tee of FIG. 7 and the upper and lower parts of the column comprising the tee of FIG. 9.

The upper part 27C of column 22C comprising tee 20C and the upper and lower parts 27D and 26D respectively comprising column 22D of tee 20D have helical configurations as previously explained. An enlarged fragmentary portion which is typical of each of these parts is shown in FIG. 11 of the drawings and such part has spring means S embedded in the elastomeric material.

The spring means comprises a coiled mechanical spring construction S suitably embedded in a helical pattern as shown and such spring construction S is cross-hatched generally in the drawing but may be made of metal, hard plastic, or any suitable material.

For simplicity, each of the various tees has been shown in the drawing with its major portions cross-hatched to indicate a rubber compound; however, it is to be understood that each could be made of a suitable plastic material or any other suitable yeildable resilient material.

The various tees and portions thereof may be made using any suitable manufacturing technique known in the art. For example, either the entire tee or certain parts may be made by regular molding, injection molding, blow molding, continuous extrusion, and the like.

The dimensions of the tee of this invention will vary depending on the yieldable resilient material selected. Basically the base of each tee has a diameter of roughly five to six inches so that it may be supported either on a grassy or dirt surface as well as on a permanent home plate. Further, with this diameter the tee is easily knocked over thus reducing any tendancy for a stinging sensation to be transmitted through a bat to the hands of a batter.

The height of the single piece tees such as tees 20 and 20A disclosed herein will vary and a typical height is 32 inches. Obviously, the tee 20 will be made comparatively tall and may be cut by a user to the desired height.

In the case of the tees having columns made of two pieces the overlap between the telescoped parts is sufficient to enable adjustment to any desired distance. It has been found that vertical adjustment of from a low of 24 inches to 32 inches is adequate for boys 6 through 8 years of age.

It will also be appreciated that the ball supporting surface may be any suitable configuration as mentioned earlier. In the case of an annular surface such as surfaces 23, 23A, 23B, 23C, 23D, and 23M it has been found that a regulation baseball may be easily supported on such a surface having an inside diameter of 1¼ inches an outside diameter of 1⅝ inches and thus a wall thickness of 3/16 inch. Obviously, for the lower parts of the two piece columns the diameter and wall thicknesses thereof will vary depending on the elastomeric material used and the dimensions of the upper parts used therewith.

In this disclosure the upper parts of two piece columns 22B, 22C and 22D are shown telescoped within their associated lower parts; however, it is to be understood such upper parts could be telescoped either slidably or threadedly outside of their lower parts and the telescoping action presented in the claims is also intended to cover the telescoping action described in this paragraph.

It will also be appreciated that certain ones of the tees may be made of a comparatively thin material and be of the air inflatable variety. For example, the tee of FIG. 4 may be made of a thin air inflatable elastomeric material and once inflated with air would assume the configuration shown in the drawing and have an integral top ball supporting surface.

While present exemplary embodiments of this invention, and methods of practicing the same, have been illustrated and described, it will be recognized that this invention may be otherwise variously embodied and practiced within the scope of the following claims.

What is claimed is:

1. A baseball and softball type ball tee comprising, a base and an upstanding column carried by said base and having means for supporting a ball having an external diameter within the range of the diameter of a standard baseball to the diameter of a standard softball, said base and column being a single-piece construction and being dimensioned to enable said tee to be knocked over easily, said column having a vertical dimension which is substantially greater than the largest horizontal dimension of said base, said base and column being substantially entirely of a yieldable resilient elastomeric material, said base and column being hollow and each being of substantially uniform wall thickness throughout its vertical height, said column being adapted to be struck by said ball bat with said column and bat remaining intact and said base and column being adapted to be easily flattened transverse a longitudinal axis therethrough upon applying compressive forces thereagainst to thereby assure a person falling thereon will be free of injury, said hollow base having a substantially cup-shaped configuration terminating in a bottom annular supporting edge, said column having a vertical dimension which is at least several times greater than the diameter of said softball.

* * * * *